US006569359B2

(12) United States Patent
Yukinobu et al.

(10) Patent No.: US 6,569,359 B2
(45) Date of Patent: May 27, 2003

(54) TRANSPARENT CONDUCTIVE LAYER FORMING COATING LIQUID CONTAINING FORMAMIDE

(75) Inventors: Masaya Yukinobu, Ichikawa (JP); Kennichi Fujita, Ichikawa (JP); Atsushi Tofuku, Ichikawa (JP); Kenji Kato, Ichikawa (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 26 days.

(21) Appl. No.: 09/910,880

(22) Filed: Jul. 24, 2001

(65) Prior Publication Data

US 2002/0047108 A1 Apr. 25, 2002

(30) Foreign Application Priority Data

Jul. 25, 2000 (JP) ..... 2000-224501

(51) Int. Cl.[7] ..... H01B 1/22
(52) U.S. Cl. ..... 252/514; 106/1.18; 106/1.19
(58) Field of Search ..... 252/514; 106/1.18, 106/1.19

(56) References Cited

U.S. PATENT DOCUMENTS 6,086,790 A * 7/2000 Hayashi et al. ..... 252/500
6,261,479 B1 * 7/2001 Yukinobu et al. ..... 252/514
6,471,889 B1 * 10/2002 Hayashi et al. ..... 252/520.1
2002/0037398 A1 * 3/2002 Tofuku et al. ..... 428/325

FOREIGN PATENT DOCUMENTS

| | | | |
|---|---|---|---|
| JP | 8-77832 | A | 3/1996 |
| JP | 9-55175 | A | 2/1997 |
| JP | 9-115438 | A | 5/1997 |
| JP | 10-1777 | A | 1/1998 |
| JP | 10-142401 | A | 5/1998 |
| JP | 10-182191 | A | 7/1998 |
| JP | 11-228872 | A | 8/1999 |
| JP | 2000-124662 | A | 4/2000 |
| JP | 2000-268639 | A | 9/2000 |

* cited by examiner

*Primary Examiner*—Mark Kopec
(74) *Attorney, Agent, or Firm*—Oliff & Berridge, PLC

(57) ABSTRACT

The object is to provide a transparent conductive layer forming coating liquid capable of forming a transparent conductive layer having such characteristics as high transmittance, low resistance, low reflectance and high strength and with few film defects. The transparent conductive layer forming coating liquid of the present invention is characterized in that it comprises, as its main components, a solvent and noble metal microparticles with a mean particle diameter of 1 to 100 nm dispersed in the solvent, and that the above-mentioned solvent comprises 0.005 to 1.0 wt % of formamide ($HCONH_2$). Further, using this transparent conductive layer forming coating liquid, it is possible to form a conductive layer with developed meshy structures easily so that it can form transparent conductive layers having such characteristics as high transmittance, low resistance, low reflectance and high strength and with few film defects.

14 Claims, 1 Drawing Sheet

TRANSPARENT CONDUCTIVE LAYER FORMING COATING LIQUID CONTAINING FORMAMIDE

BACKGROUND OF THE INVENTION

1. Field of the Invention

The present invention relates to a transparent conductive layer forming coating liquid for preparing a transparent conductive layer on a transparent substrate. The present invention particularly relates to a transparent conductive layer forming coating liquid that forms a transparent conductive layer with an excellent transmission profile in the range of visible light, weather resistance and provision of an excellent anti-reflection effect and electric field shielding affect in the case that a transparent conductive layered structure on which the above-mentioned transparent conductive layer is formed is used in front panels of display devices such as Braun tubes (CRTs), plasma display panels (PDPs), vacuum fluorescent displays (VFDs), liquid crystal displays (LCDs), and so on.

2. Description of the Related Art

Some conditions are required for a cathode ray tube (also called a Braun tube as mentioned above: CRT) now being used for computer displays, and so on. It must be easy to see the display screen 3 in order to prevent visual fatigue, as well as prevent deposition of dust and electric shock induced by the electrostatic charge on the CRT screen, etc. Furthermore, in addition to the requirements, there has recently been concern over the detrimental effects of low-frequency electromagnetic waves generated by CRTs on the human body and there is a demand for CRTs with which there is no leakage to the outside of such electromagnetic waves.

Further, in recent years, the problems of the above-stated electrostatic charge and leakage of electromagnetic waves are also pointed out in plasma display panels (PDP) used for wall-hung TVs, and so on, as in CRTs.

It is possible to prevent such leakage of electromagnetic waves, for example, by coating the front panel surface of a display with a transparent conductive layer.

The above-stated method for preventing the leakage of electromagnetic waves is theoretically the same as measures that have been adopted in recent years to prevent electrostatic charging. However, conductivity of the above-mentioned transparent conductive layer must be much higher than that of conductive layers that are formed to prevent electrostatic charging (surface resistance of approximately $10^8$ to $10^{10}$ Ω/□, ohm per square).

That is, in CRTs, a transparent conductive layer with at least as low a resistance as $10^6$ Ω/□ or less, preferably $5\times10^3$ Ω/□ or less, and more preferably $10^3$ Ω/□ or less is preferred for prevention of leakage of an electric field (electric field shielding). On the other hand, in PDPs, 10 Ω/□ or less is demanded, for instance.

Moreover, several suggestions have been made thus far to take measures for the above-mentioned electric field shielding. For instance, in CRTS, there are proposals having been suggested, such as, (1) a method wherein a coating liquid for forming a transparent conductive layer in which conductive oxide microparticles such as indium tin oxide(ITO) and so on, or metal microparticles dispersed in a solvent is applied to the front glass (a front panel) of a CRT and dried and then baked at a temperature of approximately 200° C. for forming the above-stated transparent conductive layer, (2) a method for forming a transparent conductive tin oxide layer (a Nesa layer) on a front glass (a front panel) by a high temperature chemical vapor deposition (CVD) method of tin chloride, and (3) a method for forming a transparent conductive layer on a front glass (a front panel) by sputtering indium tin oxide, titanium oxynitride and so on.

Also in PDPs, several methods have been proposed, such as, (4) a method for forming a transparent conductive film on the above-stated front panel by sputtering metals such as silver and so on, and (5) a method for forming a conductive film by setting an conductive mesh made by metal or metal-coated fibers on a front panel at the main device body side of the front panel in PDPs.

However, there are some problems in the method (5) in PDP, that is, although low surface resistance is obtained by using a conductive mesh, the transmittance gets lower and moire occurs. Furthermore, the manufacturing processes for forming a conductive layer are complicated and cost rises accordingly.

On the other hand, the method shown in (1) in CRTs is very simple when compared to other methods of forming a transparent conductive layer such as a CVD method or sputtering method shown in (2) to (4), and has a low production cost. As a result thereof, the method (1) that uses a coating liquid for forming a transparent conductive layer is a very useful method not only in the above-stated CRTs but also in PDPs.

However, in the method shown in (1) that employs conductive oxide microparticles such as indium tin oxide (ITO) and so on, as a coating liquid for forming a transparent conductive layer, surface resistance of the film that is obtained is high at $10^4$ to $10^6$ Ω/□, which was not sufficient for blocking leakage of an electric field.

On the other hand, when compared to coating liquids that use ITO, a film with somewhat lower transmittance, but also low resistance of $10^2$ to $10^3$ Ω/□, is obtained with coating liquids for forming transparent conducive layers that employ metal microparticles, and this will probably be the promising method of the future.

Moreover, the metal microparticles that are used in the above-mentioned coating liquid for forming the above-mentioned transparent conductive layer are limited to noble metals, such as silver, gold, platinum, rhodium, palladium, etc., that rarely oxidize in air, as shown in Japanese Patent Applications Laid-Open No. H 8-77832 and Laid-Open No. H 9-55175. This is because if microparticles of a metal other than a noble metal, such as iron, nickel, cobalt, etc., are used, an oxide film is invariably formed on the surface of such metal microparticles in an air atmosphere and good conductivity cannot be obtained as a transparent conductive layer.

Moreover, on the other hand, in order to make the display screen easy to see, anti-glare treatment is performed on the front panel surface to prevent reflection on the screen, for example, in CRTs.

This antiglare treatment is performed by the method whereby fine irregularities are made in the surface in order to increase diffused reflection at the surface, but it cannot be said that this method is a very desirable method because when used, resolution decreases and picture quality drops.

Consequently, it is preferred that antiglare treatment be performed by the interference method whereby the refractive index and film thickness of the transparent film be controlled so that there is destructive interference of the incident light by the reflected light.

A two-layered film structure wherein optical film thickness of film with a high refractive index and film with a low refractive index has been set at ¼λ and ¼λ, or ½λ and ¼λ, respectively, is usually used in order to obtain this type of low-reflection effect of the interference method, and film consisting of the above-mentioned indium tin oxide (ITO) microparticles is also used as this type of film with a high refractive index.

Furthermore, of the optical constant (n-ik, n: refractive index, $i^2=-1$, k: extinction coefficient) of metals, the value of n is small, but the value of k is very large, and therefore, even if a transparent conductive layer consisting of metal microparticles is used, the same anti-reflection activity induced by interference of light as seen with ITO (film with a high refractive index) is obtained with the two-layered film structure.

Besides, as for the transparent conductive layered structure wherein the transparent conductive layer of this kind is formed on the transparent substrate, a specific feature is in recent years required to enhance contrast of pictures by controlling the transmittance to be set in the prescribed range (40 to 75%) less than 100% in order to make the display panel easier to see, in addition to some other features such as the above-stated excellent conductivity and low reflectance. And in this case, blending color pigment microparticles and so on with the above-stated coating liquid for forming a transparent conductive layer is also performed.

Since the noble metal microparticles, naturally are not transparent to visible lights, the conductive film to which noble metal microparticles are applied is preferably the one on which the least possible amount of noble metal microparticles forms conductive paths efficiently in the transparent conductive layer, in order to obtain both high transmittance and low resistance in the above-stated transparent conductive layer.

Moreover, in the general coating liquid for a transparent conductive layer, comprising, as main components, a solvent and noble metal microparticles, the noble metal microparticles tend to aggregate compared with oxide microparticles and during the process for forming a film in which a coating liquid for forming a transparent conductive layer is applied and dried, microparticles aggregate to a certain extent inevitably. Accordingly, the transparent conductive film gained by applying a coating liquid for forming a transparent conductive layer has a structure in which fine holes are introduced into the conductive layer of noble metal microparticles, that is, a meshy (network) structure (see the descriptions in Industrial Materials (Kogyo Zairyo) Vol.44, No.9, 1996, pp68–71, Japanese Patent Applications Laid-Open No. H 9-115438, Laid-Open No. H 10-1777, Laid-Open No. H 10-142401, Laid-Open No. H 10-182191 and so on). When such meshy structure is formed, a transparent conductive layer with low resistance and high transmittance is obtained. It is supposed that this is because, while the meshy structure comprising metal microparticles has a function as conductive paths, the holes formed in the meshy structure have a function for enhancing the light transmittance.

In the case that the conventional coating liquid for forming a transparent conductive layer is applied, forming the transparent conductive layer having a meshy structure is a certain extent possible, as stated above. However it is actually difficult to control the aggregation occurring during the process for forming a film in which a coating liquid for forming a transparent conductive layer is applied and dried, and a failure in this control might cause the following film defects.

For example, when using the conventional coating liquid for forming a transparent conductive layer wherein a binary system solvent comprising ethanol which is an organic solvent having a low boiling point (the boiling point is lower than 100° C.) and water, or a solvent, to the system of which a small amount (15 wt % or less) of an organic solvent having a high boiling point (the boiling point is 100° C. or higher) is added, is employed, it is found that a developed meshy structure can be formed easily in the transparent conductive film that is obtained. This is probably because of high surface tension of water, since an organic solvent having a low boiling point (ethanol) volatilizes faster than water in the process wherein a coating liquid for forming a transparent conductive layer is applied to a substrate and dried, so that a large amount of water may remain in the coated film just before drying. However, such coating liquid for forming a transparent conductive layer is very sensitive to traces of wiping when cleaning a substrate or spots on a substrate (oil spots, for example) because of a large amount of water remaining in the coated film just before drying, and in addition, drying speed of the coating liquid is too high because the liquid contains a large amount of an organic solvent having a lower boiling point than water. As a result thereof, in the case of forming a film with the coating liquid for forming a transparent conductive layer by spin coating, there is a problem that defects of a film occur in which radial striations (streaky unevenness formed radially from the center of a substrate toward outside) and corner unevenness (shading unevenness formed in the four corners of a substrate) are more induced.

In this case, it is possible to improve the condition by using a large amount of an organic solvent having a high boiling point (the boiling point is 100° C. or higher) as a coating liquid for forming a transparent conductive layer, because drying speed of the coating liquid can be controlled slower thereby. However, in this case, the above-stated meshy structure could not be sufficiently gained or another defect in a film (occurrence of fine aggregates all over the film) was caused by over-aggregation of noble metal microparticles.

In addition, in order to form the above-mentioned meshy structure more positively, it is proposed in Japanese Patent Applications Laid-Open No. 2000-124662 to use a coating liquid for forming a transparent conductive layer including metal microparticles that are made to aggregate in a concatenate manner beforehand. However, in this coating liquid for forming a transparent conductive layer, since the aggregates of metal microparticles are formed in advance, a filter tends to be clogged during the process of filtration of the coating liquid for forming a transparent conductive layer, which is carried out before forming a film. And besides, there was a problem that the above-mentioned defect in a film was caused by over-aggregation of noble metal microparticles, just as stated above.

SUMMARY OF THE INVENTION

The present invention focuses on such problems, its object being to present a transparent conductive layer forming coating liquid capable of forming a more developed meshy structure easily, having such characteristics as high transmittance, low resistance, low reflectance and high strength, and moreover, capable of forming a transparent conductive layer with few defects in a film.

That is, the invention of claim 1 resides in a transparent conductive layer forming coating liquid for forming a transparent conductive layer on a transparent substrate, comprising, as its main components, a solvent and noble metal microparticles with a mean particle diameter of 1 to 100 nm dispersed in the solvent, wherein the solvent comprises 0.005 to 1.0 wt % of formamide ($HCONH_2$).

Moreover, the invention of claim 2 resides in a transparent conductive layer forming coating liquid according to claim 1, wherein the solvent comprises an organic solvent being compatible with water and having a boiling point of 100 to 190° C., 1 to 50 wt % of water, and monohydric alcohol containing 5 carbon atoms or less or/and ketone containing 6 carbon atoms or less.

The invention of claim 3 resides in a transparent conductive layer forming coating liquid according to claim 1 or 2, wherein the noble metal microparticles are any of: noble metal microparticles selected from gold, silver, platinum, palladium, rhodium, and ruthenium; alloy microparticles of these noble metals; or noble metal-coated silver microparticles the surface of which is coated with these noble metals other than silver.

The invention of claim 4 resides in a transparent conductive layer forming coating liquid according to claim 3, wherein the noble metal-coated silver microparticles are silver microparticles coated with gold or platinum only or a composite of gold and platinum.

The invention of claim 5 resides in a transparent conductive layer forming coating liquid according to claim 4, wherein the coated amount of gold or platinum only or a composite of gold and platinum in the noble metal-coated silver microparticles is set in the range from 5 to 1900 parts by weight to 100 parts by weight of silver.

Next, the invention of claim 6 resides in a transparent conductive layer forming coating liquid according to any of claims 1 through 5, including color pigment microparticles.

The invention of claim 7 resides in a transparent conductive layer forming coating liquid according to claim 6, wherein the color pigment microparticles are one or more types of microparticles selected from carbon, titanium black, titanium nitride, composite oxide pigment, cobalt violet, molybdenum orange, ultramarine, Prussian blue, quinacridone pigment, anthraquinone pigment, perylene pigment, isoindolinone pigment, azo pigment, and phthalocyanine pigments The present invention of claim 8 resides in a transparent conductive layer forming coating liquid according to any of claims 1 through 7, including an inorganic binder.

DESCRIPTION OF THE PREFERRED EMBODIMENTS

Figure 1:
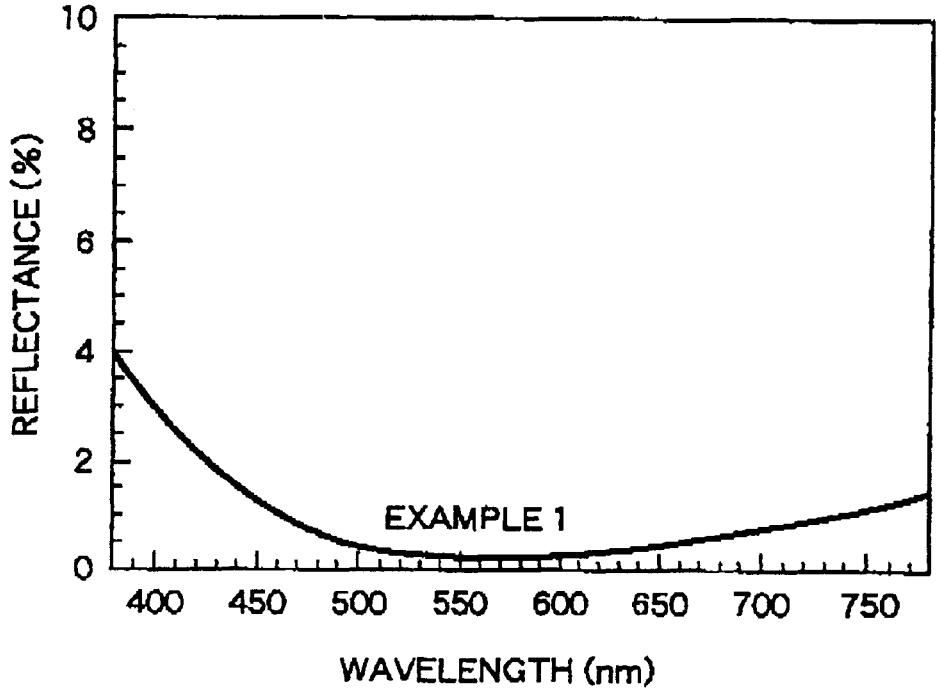
FIG. 1 is a graph showing the reflection profile of the transparent conductive layered structure of the Example 1.

The preferred embodiments of the present invention will now be described in detail.

First, the present invention was completed based on the discovery that when a small amount of formamide ($HCONH_2$) is added to a transparent conductive layer forming coating liquid comprising noble metal microparticles, the above-stated meshy structure can be easily formed in the process of forming a film wherein a transparent conductive layer forming coating liquid is applied and dried, and a transparent conductive film with higher transmittance and lower resistance can be obtained than conventional techniques, thereby.

Moreover, formamide ($HCONH_2$) has a high boiling point of 210° C. so that it does not volatilize easily. As a result thereof, even if a very small amount of formamide is added to a transparent conductive layer forming coating liquid, it is thought to reach high concentration just before the coating film is dried so that it performs a function for forming the above-stated meshy structure. In addition, during the applying and drying process of forming a film, the concentration of formamide in the coated film rises according to the volatilization of a solvent other than formamide which is accompanied with the drying. However, since the added volume of formamide in the transparent conductive layer forming coating liquid is very small, film defects (fine aggregates occur all over the surface of the film) are not caused by aggregating the noble metal microparticles in the coating liquid during the midst of drying.

Furthermore, the mechanism of forming the above-stated meshy structure without any film defect by addition of a very small amount of formamide is not obvious, but supposedly, it might be attributed to the high surface tension of formamide (57.9 dyn/cm, 25° C.).

Here, as for the solvent used for the transparent conductive layer forming coating liquid of the present invention, the formamide ($HCONH_2$) content must be 0.005 to 1.0 wt % (claim 1), preferably, 0.02 to 0.7 wt %. When the formamide content is less than 0.005 wt %, the effect of formamide that forms the above-stated meshy structure is not obtained. Moreover, when it is more than 1.0 wt %, since the drying the coated liquid gets extremely slow, it becomes difficult to form a transparent conductive layer. Even in the case of setting the frying time very long and performing the drying, it is not practical because of the far lower productivity of the transparent conductive layers. Further, since formamide sometimes inhibits the stability of the transparent conductive layer forming coating liquid according to the kind of the noble metal microparticles which are employed in the transparent conductive layer forming coating liquid, the addition of formamide more than 1.0 wt % is not preferable, either in this sense.

Next, as for the solvent which Is employed in the above-stated transparent conductive layer forming coating liquid, it is appropriately selected based on the application method of the coating liquid, and for example, it includes a solvent comprising an organic solvent being compatible with water and having a boiling point of 100 to 190° C., 1 to 50 wt % of water, and monohydric alcohol containing 5 carbon atoms or less and/or ketone containing 6 carbon atoms or less (claim 2).

Moreover, as for an organic solvent being compatible with water and having a boiling point of 100 to 190° C., examples are glycol derivatives such as ethylene glycol monomethyl ether (MCS), ethylene glycol monoethyl ether (ECS), ethylene glycol monoisopropyl ether (IPC), ethylene glycol monobutyl ether (BCS), propylene glycol monomethyl ether (PGM), propylene glycol ethyl ether (PE), etc., diacetone alcohol (DAA), N-methylformamide, dimethylformamide (DMF), dimethylacetamide (DMAC), demethyl sulfoxide (DMSO), etc., but the solvent is not limited to these examples.

In addition, since a transparent conductive layer forming coating liquid comprising noble metal microparticles is usually obtained via a water system colloidal dispersion of noble metal microparticles, the solvent always contains water and the water content is 1 to 50 wt %, preferably 5 to 25 wt %, as stated above. This is because if it exceeds 50 wt %, cissing due to the high surface tension of the water may readily occur during drying once this coating liquid for forming a transparent conductive layer on a transparent substrate has been applied. Moreover, if the above-stated water content is less than 1 wt %, it is necessary to produce a water system colloidal dispersion wherein the noble metal microparticle content is as high as approximately 30 wt %, but it is not practical because the dispersion becomes unstable and aggregation of noble metal microparticles is induced when the noble metal microparticle content is so high in the dispersion.

Next, as for monohydric alcohol containing 5 carbon atoms or less, examples are methanol (MA), ethanol (EA), 1-propanol (NPA), isopropanol(IPA), butanol and pentanol, but ethanol and isopropanol are preferable because of their high speed of drying and less detrimental effects. Further, as for ketone containing 6 carbon atoms or less, examples are acetone, methyl ethyl ketone (MEK), methyl propyl ketone, methyl isobutyl ketone (MIBK) and cyclohexanone and so on, but acetone and methyl ethyl ketone are preferable because of their high speed of drying.

Here, the noble metal microparticles of the present invention should have a mean particle diameter of 1 to 100 nm (claim 1). In the above-stated microparticles, when the mean particle diameter is less than 1 nm, it will be difficult to produce these microparticles, and they will also readily aggregate in the transparent conductive layer forming coating liquid, making such microparticles impractical. Moreover, if the mean particle diameter exceeds 100 nm, visible light ray transmittance of the formed transparent conductive layer will be too low. In this case, even if a thinner film is designed in order to improve visible light ray transmittance, surface resistance will be too high and the particles will be impractical.

Furthermore, the mean diameter as used here means the mean particle diameter of microparticles observed under a transmission electron microscope (TEM).

In addition, the above-stated noble metal microparticles can be employed from any of: noble metal microparticles selected from gold, silver, platinum, palladium, rhodium, and ruthenium; alloy microparticles of these noble metals; or noble metal-coated silver microparticles the surface of which is coated with these noble metals other than silver (claim 3).

Besides, when the specific resistance is compared among silver, gold, platinum, rhodium, palladium, and ruthenium, specific resistance of platinum, rhodium, palladium, and ruthenium is 10.6, 5.1, 10.8, 6.71 $\mu\Omega\cdot$cm, respectively, which is high when compared to the 1.62 and 2.2 $\mu\Omega\cdot$cm of silver and gold. Therefore, it is more of an advantage to use silver microparticles and gold microparticles to form a transparent conductive layer with low surface resistance.

There is, however, a problem with weather resistance in that there is severe deterioration due to sulfurization and exposure to brine, when silver microparticles are used, as a result thereof, the usage is limited. On the other hand, when gold microparticles, platinum microparticles, rhodium microparticles, palladium micriparticles, and ruthenium micriparticles are used, there are none of the above-mentioned problems with weather resistance, but considering the cost, they are not optimum, either.

Therefore, the microparticles wherein the surface of the silver microparticles is coated with other noble metal than silver can be used. For example, the inventors previously presented a transparent conductive layer forming coating liquid in which are used noble metal-coated silver microparticles with a mean particle diameter of 1 to 100 nm, wherein the surface of the silver microparticles is coated with gold or platinum only or a composite of gold and platinum, and the method of producing the same (refer to Japanese Patent Application Laid-Open No. H 11-228872 and Specification of Japanese Patent Application No. H 11-366343).

In addition, in the above-stated noble metal-coated silver microparticles, specific resistance of platinum is somewhat higher than that of silver and gold, as previously mentioned, and therefore, Ag—Au system is more preferable than Ag—Pt system or Ag—Au—Pt system, considering the surface resistance of the transparent conductive layer. However, since gold or platinum only or a composite of gold and platinum is used as coating layer on the surface of the above-mentioned silver microparticles, the good electrical conductivity of the silver is not lost to such an extent that it falls below the level needed for practical application, when the above-stated Ag—Pt system or Ag—Au—Pt system is used.

Next, in the above-stated noble metal-coated silver microparticles, the coated amount of gold or platinum only or a composite of gold and platinum is preferably set within a range from no less than 5 parts by weight up to 1900 parts by weight to 100 parts by weight of silver, more preferably set within a range no less than 100 parts by weight up to 900 parts by weight. When the coated amount of gold or platinum only or a composite of gold and platinum is less than 5 parts by weight, deterioration of the film by the influence of ultraviolet rays, etc., is easy to occur, and therefore, no protective effect of the coating will be observed, while exceeding 1900 parts by weight is prohibitive in terms of cost, and productivity of the noble metal-coated silver microparticles goes down, as well.

Moreover, weather resistance, chemical resistance, ultraviolet ray resistance, etc., will be improved remarkably when the surface of the silver microparticles is coated with gold or platinum only or a composite of gold and platinum because the silver inside the noble-metal coated silver microparticles is protected by the gold or platinum only or by the composite of gold and platinum.

Next, color pigment microparticles can also be added to the above-stated transparent conductive layer forming coating liquid (claim 6). By the addition of the color pigment microparticles, transmittance of the transparent conductive layered structure wherein the transparent conductive layer is formed, is set in the prescribed range (40 to 75%) less than 100%, and as a result thereof, it is possible to make the display panel easier to see by enhancing contrast of the pictures, in addition to some other features such as the above-stated excellent conductivity and low reflectance are gained.

And the above-stated color pigment micoparticles can be used one or more types of microparticles selected from carbon, titanium black, titanium nitride, composite oxide pigment, cobalt violet, molybdenum orange, ultramarine, Prussian blue, quinacridone pigment, anthraquinone pigment, perylene pigment, isoindolinone pigment, azo pigment and phthalocyanine pigment (claim 7).

Next, the transparent conductive layer forming coating liquid wherein noble metal-coated silver microparticles are used for the noble metal microparticles and the solvent comprises formamide ($HCONH_2$) can be produced by the following method. First, a colloidal dispersion of silver microparticles is prepared by a conventional method (for instance, the Carey-Lea method. Am. J. Sci., 37, 47 (1889), Am. J. Sci., 38 (1889)). That is, a composite solution of aqueous iron sulfate (II) solution and aqueous sodium citrate solution is added to an aqueous silver nitrate solution and reacted, and then the precipitate is filtered and washed and then pure water is added. Thus, a colloidal dispersion of silver micoparticles (Ag: 0.1 to 10 wt %) can be easily prepared. The method of preparing a colloidal dispersion of silver microparicles is not limited to this method, and it is possible to use any method as long as silver microparticles with a mean particle diameter of 1 to 100 nm are dispersed.

Next, the surface of the above-mentioned silver microparticles can be coated with gold or platinum only, or a composite of gold and platinum by adding reducing agent to the colloidal dispersion of silver microparticles that is obtained, and then further adding alkali metal aurate solution or alkali metal platinate solution, or adding alkali metal platinate solution and alkali metal aurate solution, or adding a mixed solution of alkali metal aurate and alkali metal platinate. A colloidal dispersion of noble metal-coated microparticles can be obtained in this way. A trace of dispersant may be added to at least one, or to all of, the colloidal dispersion of silver microparticles, alkali metal aurate solution, alkali metal platinate solution, and mixed solution of alkali metal aurate and alkali metal platinate during this process of preparing the noble metal-coated silver microparticles as needed.

Furthermore, hydrazine ($N_2H_4$) borohydrates such as sodium borohydrate ($NaBH_4$), etc., formaldehyde, etc., can be used as the above-mentioned reducing agent, but the reducing agent is not limited to these and any can be used as long as it does not cause aggregation of the silver microparticles, and can reduce the aurate and platinate to gold and platinum when it is added to the colloidal dispersion of silver microparticles.

For instance, the reduction reaction when potassium aurate [$KAu(OH)_4$] and potassium platinate [$K_2Pt(OH)_6$] are reduced by hydrazine or sodium borohydrate are each shown below:

$$KAu(OH)_4+\tfrac{3}{4}N_2H_4 \rightarrow Au+KOH+3H_2O+\tfrac{3}{4}N_2\uparrow$$

$$K_2Pt(OH)_6+N_2H_4 \rightarrow Pt+2KOH+4H_2O+N_2\uparrow$$

$$KAu(OH)_4+\tfrac{3}{4}NaBH_4 \rightarrow Au+KOH+\tfrac{3}{4}NaOH+\tfrac{3}{4}H_3BO_3+3/2\ H_2\uparrow$$

$$K_2Pt(OH)_4+NaBH_4 \rightarrow Pt+2KOH+NaOH+H_3BO_3+2H_2\uparrow$$

Here, when the above-mentioned sodium borohydrate is used as the reducing agent, there is an increase in the concentration of electrolytes produced by the reduction reaction, as can be seen from the above-mentioned reaction formula, and therefore, microparticles will easily aggregate, as mentioned later. The amount of reducing agent is thereby limited and there is a disadvantage in that the silver concentration of the colloidal dispersion of silver microparticles that is used cannot be made high, On the other hand, when the above-mentioned hydrazine is used as the reducing agent, little electrolyte is produced by the reduction reaction, as can be confirmed by the above-mentioned reaction formula, and therefore, it is a preferable reducing agent.

Incidentally, when salts other than alkali metal aurate or alkali metal platinate, such as chloroauric acid ($HAuCl_4$), chloroplatinic acid ($H_2PtCl_6$), or chloroaurates ($NaAuCl_4$, $KauCl_4$, etc.), or chloroplatinates ($Na_2PtCl_6$, $K_2PtCl_6$, etc.) are used as the gold and platinum coating starting materials, the reduction reaction by hydrazine is as follows:

$$XAuCl_4+\tfrac{3}{4}N_2H_4 \rightarrow Au+XCl+3HCl+\tfrac{3}{4}N_2\uparrow$$

$$X_2PtCl_6+N_2H_4 \rightarrow Pt+2XCl+4HCl+N_2\uparrow$$

(X=H, Na, K, etc.)

Thus, when chloroauric acid, etc. are used, not only is the electrolyte concentration increased due to the reduction reaction, but chlorine ions are also produced when compared to the case where the above-mentioned aurate or platinate is used and therefore, these react with the silver microparticles to form silver chloride which is hardly soluble. Consequently, they are difficult to use as the starting material for forming the transparent, conductive layer of the present invention.

The colloidal dispersion of noble metal-coated silver microparticles obtained in this way preferably should then be subjected to desalting treatment, such as dialysis, electrodialysis, ion exchange, ultrafiltration, etc. so as to lower its electrolyte concentration. This is because colloids generally aggregate with electrolytes when the electrolyte concentration is high. This phenomenon is known as the Schulze-Hardy rule.

Next, a concentrated dispersion of noble metal-coated silver microparticles is obtained by concentration of the colloidal dispersion of noble metal-coated silver microparticles that have been treated by desalting and the transparent conductive layer forming coating liquid according to the present invention is obtained by adding formamide ($HCONH_2$), an organic solvent being compatible with water and having a boiling point of 100 to 190° C., and monohydric alcohol containing 5 carbon atoms or less and/or ketone containing 6 carbon atoms or less, or further these solvent including an inorganic binder (claim 8) to this concentrated dispersion of noble metal-coated silver microparticles and adjusting the components (microparticle content, water content, high boiling point organic solvent content, etc.).

Moreover, an inorganic binder can be added and mixed in the condition of being included in the concentrated dispersion of the noble metal-coated silver microparticles or in the solvent. Adding the binder only is also possible, and the mixing can be performed arbitrarily.

The above-mentioned concentration treatment of the colloidal dispersion of the noble metal-coated silver microparticles can be accomplished by any normal methods such as a reduced-pressure evaporator, ultrafiltration, etc., and the water content of the transparent conductive layer forming coating liquid can be controlled in the range of the above-mentioned 1 to 50 wt % according to the extent of the concentration.

When the above-mentioned ultrafiltration is used as the desalting treatment method, desalting and concentration can be performed simultaneously because this ultrafiltration acts as a concentration treatment, as is described below. Thus, it is possible to set the order of desalting and concentration of the colloidal dispersion in which noble metal-coated silver microparticles are dispersed as needed based on the treatment system that is used, and if ultrafiltration, etc., are employed, simultaneous treatment is also possible.

In addition, as stated above, an organic solvent used for the transparent conductive layer forming coating liquid can include an organic solvent being compatible with water and having a boiling point of 100 to 190° C., monohydric alcohol containing 5 carbon atoms or less and ketone containing 6 carbon atoms or less, but there are no special restrictions to the other organic solvents, and it is selected as needed based on the application method and film-production conditions. Examples are alcohol solvents other than the above-mentioned, ketone solvents, glycol derivatives, N-methyl-2-pyrrolidone (NMP), etc., but it is not limited to these.

Further, the transparent conductive layer forming coating liquid according to the present invention can be obtained in the similar way, even when a colloidal dispersion of one or more types of metal microparticles selected from gold, silver, platinum, palladium, rhodium, and ruthenium or alloy microparticles of these noble metals are used instead of the above-stated colloidal dispersion of noble metal-coated silver microparticles.

Next, for instance, a transparent conductive layered structure, whose main components are a transparent substrate and a transparent two-layered film composed of a transparent conductive layer and a transparent coat layer formed in succession on this transparent substrate, can be obtained by using the transparent conductive layer forming coating liquid according to the present invention obtained in this way.

Moreover, the following method can be used to form the above-mentioned transparent two-layered film on a transparent substrate. That is, a transparent conductive layer forming coating liquid according to the present invention is applied by any method, such as spray coating, spin coating, wire bar coating, doctor blade coating, etc., to a transparent substrate, such as a glass substrate, plastic substrate, etc., and when necessary, after drying, overcoating with, for instance, a transparent coat layer forming coating liquid whose main component is silica sol, etc., is performed by the above-mentioned method. Next, heat treatment is performed at a temperature of, for instance, approximately 50 to 350° C. and the coated transparent coat layer is cured to form the above-mentioned two-layered film.

When a transparent conductive layer forming coating liquid with which formamide ($HCONH_2$) is mixed according to the present invention is used, well developed meshy structure of the noble metal microparticle layer and high quality transparent conductive layer without film defect can be formed, compared to the use of the conventional transparent conductive layer forming coating liquid in which formamide ($HCONH_2$) is not included.

Improvement of transmittance and improvement of conductivity are simultaneously realized here when the transparent coat layer forming coating liquid whose main component is silica sol, etc., is overcoated by the above-mentioned methods because the silica sol liquid that has been overcoated (this silica sol liquid becomes a binder matrix whose main component is silicon oxide with the above-mentioned heat treatment) soaks into the holes in the meshy structure of the noble metal microparticle layer that was formed by pre-application.

Furthermore, strength can also be improved because the transparent substrate and the binder matrix of silicon oxide etc., attach to each other in a larger contact surface area via the above-mentioned holes of the meshy structure, which makes the binding between the transparent substrate and the binder matrix stronger.

Moreover, refractive index n of the above-mentioned optical constant (n-ik) of the transparent conductive layer wherein noble metal microparticles are dispersed in a binder matrix whose main component is silicon oxide is not very large, but the extinction coefficient k is high and therefore, the reflectance of the transparent two-layered film can be markedly reduced by the above-mentioned transparent two-layered structure film of transparent conductive layer and transparent coat layer.

Here, a polymer obtained by adding water and acid catalyst to orthoalkyl silicate for hydrolysis and then promoting dehydropolycondensation, or a polymer obtained by further promoting hydrolysis and dehydropolycondensation of a commercial alkyl silicate solution already hydrolyzed and promoted through polycondensation up to a tetramer or pentamer, etc., can be used as the above-mentioned silica sol. Furthermore, when dehydropolycondensation is promoted, the solution viscosity rises until it finally solidifies and therefore, the degree of dehydropolycondensation is adjusted to the upper viscosity limit with which application to a transparent substrate, such as a glass substrate, plastic substrate, etc., is possible or lower. There are no particular specifications for the degree of dehydropolycondensation as long as it is at the level of the above-mentioned upper viscosity limit or lower, but taking into consideration film strength, weather resistance, etc., approximately 500 to 3,000 in terms of the weight-average molecular weight is preferred. Moreover, the alkyl silicate hydrolyzed polymer forms a cured silicate film (film whose main component is silicon oxide), with the dehydropolycondensation reaction all but completed, during heating and baking of the transparent two-layered film. Furthermore, the refractive index of the transparent coat layer can be adjusted to change the reflectance of the transparent two-layered film by adding magnesium fluoride microparticles, alumina sol, titania sol, zirconia sol, etc., to the above-mentioned silica sol.

In addition, the transparent conductive layer forming coating liquid according to the present invention can be made by mixing a silica sol liquid as the inorganic binder component as stated above, in addition to the solvent with which formamide ($HCONH_2$) is mixed and the noble metal microparticles with a mean particle diameter of 1 to 100 nm dispersed in this solvent (claim 8). In this case also, the similar transparent two-layered film is obtained by applying the coating liquid for forming a transparent conductive layer comprising silica sol liquid and when necessary, after drying, overcoating a coating liquid for forming the transparent coat layer by the above-mentioned method. Furthermore, it is preferred that thorough desalting of the above-mentioned silica sol liquid to be added to the transparent conductive layer forming coating liquid be performed for the similar reasons as in the case that desalting is performed in the producing process of the colloidal dispersion of the noble metal-coated silver microparticles.

As explained above, the transparent conductive layered structure having a transparent conductive layer formed by using the transparent conductive layer forming coating liquid of the present invention has such features as high transmittance, low resistance, low reflectance and high strength because it has a more developed meshy structure of the transparent conductive layer when compared to the conventional transparent conductive layer structure. Moreover, it can be used as the front panel, etc., of displays, such as above-mentioned Braun tubes (CRTs), plasma display panels (PDPs), vacuum fluorescent displays (VFDs), field emission displays (FEDs), electroluminescence displays (ELDs), and liquid crystal displays (LCDs), etc.

EXAMPLES

Examples of the present invention will now be explained in the concrete, but the present invention is not limited to these examples. Moreover, the "%" in this text are "wt %" with the exception of the (%) used for transmittance, reflectance and haze value, and the "parts" are "parts by weight."

Example 1

A colloidal dispersion of silver microparticles was prepared by the above-mentioned Carey-Lea method.

In the concrete, after adding a mixed solution of 39 g aqueous 23% iron sulfate (II) solution and 48 g aqueous 37.5% sodium citrate solution to 33 g aqueous 9% silver nitrate solution, the precipitate was filtered and washed. Then pure water was added to prepare a colloidal dispersion of silver microparticles (Ag: 0.15%).

Next, 8.0 g aqueous 1% hydrazine nomohydrate ($N_2H_4 \cdot H_2O$) was added to 60 g of this colloidal dispersion of silver microparticles and then a mixed solution of 480 g aqueous potassium aurate [$KAu(OH)_4$] solution (Au: 0.075%) and 0.2 g aqueous 1% polymer dispersant solution were added while agitating to obtain a colloidal dispersion of noble metal-coated silver microparticles that were coated with gold only.

Once desalting of this colloidal dispersion of noble metal-coated silver microparticles was performed with an ion-exchange resin (Diaion SK1B, SA20AP; brand names of Mitsubishi Chemical Corporation), ultrafiltration was performed, and to the concentrated dispersion of the noble metal-coated silver microparticles which was obtained, ethanol(EA), propylene glycol monomethyl ether (PGM), diacetone alcohol (DAA) and formamide (FA) were added to obtain a transparent conductive layer forming coating liquid of Example 1 containing noble metal-coated silver microparticles and formamide (Ag: 0.08%, Au: 0.32%, water: 10.7%, EA: 53.8%, PGM: 25%, DAA: 10%, FA: 0.1%).

As a result of observing this transparent conductive layer forming coating liquid under a transmission electron microscope, the mean particle diameter of the noble metal-coated silver microparticles was 7.5 nm.

Next, the transparent conductive layer forming coating liquid of Example 1 comprising noble metal-coated silver microparticles was spin coated (150 rpm, 60 seconds) onto a glass substrate (soda lime glass with a thickness of 3 mm) that had been heated to 40° C. and then silica sol liquid was spin coated (150 rpm, 60 seconds) and the product was further cured for 20 minutes at 180° C. to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Example 1.

In addition, the above-mentioned glass substrate was polished with cerium oxide system abrasives and washed with pure water and dried, and then heating was performed till the substrate reaches 45° C. before using. Moreover, the surface of the substrate was wiped with a clean cloth into which ethanol infiltrated just before using, and then it was used when the temperature of the substrate was down to 40° C.

The above-mentioned silica sol liquid here was obtained by preparing a substance with an $SiO_2$ (silicon oxide) solid content of 10% and a weight-average molecular weight of 1,350 using 19.6 parts Methyl Silicate 51 (Colcoat Co.,Ltd., brand name), 57.8 parts ethanol, 7.9 parts aqueous 1% nitric acid solution, and 14.7 parts pure water and then diluting this with a mixture of isopropyl alcohol (IPA) and n-butanol (NBA) (IPA/NBA=3/1) to a final $SiO_2$ solid content of 0.8%.

Figure 2:
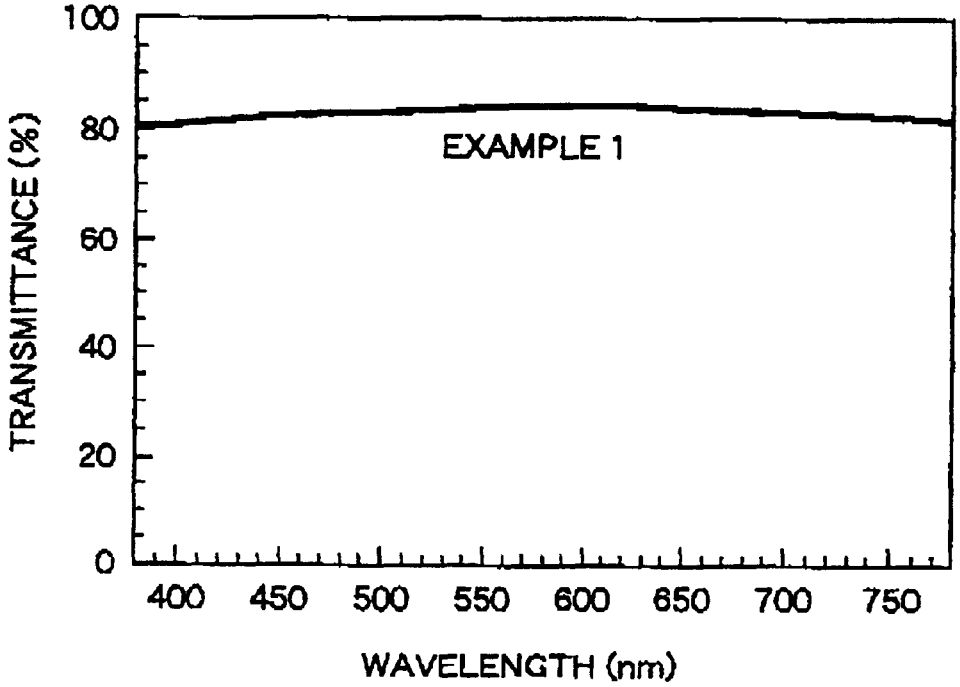
FIG. 2 is a graph showing the transmission profile of the transparent conductive layered structure of the Example 1.

Moreover, film properties of the transparent two-layered film formed on the glass substrate (surface resistance, visible light ray transmittance, standard deviation of transmittance, haze value, bottom reflectance/bottom wavelength) and the film defects are shown in Table 1. Furthermore, the above-mentioned bottom reflectance means minimum reflectance in the reflection profile of the transparent conductive layered structure, and the bottom wave length means the wavelength when reflectance is at its minimum. With regard to the above-mentioned film defects of the film visual inspection of aggregates and radial striations etc. on the film surface was performed. Moreover, the reflection profile of the transparent conductive layered structure of Example 1 is shown in FIG. 1, while the transmission profile is shown in FIG. 2.

Furthermore, transmittance of the transparent two-layered film only without the transparent substrate (glass substrate) at each wavelength in 5 nm intervals of the visible light ray wavelength region (380 to 780 nm) in Table 1 is found as follows: That is, Transmittance of transparent two-layered film only without transparent substrate (%)=[(transmittance determined inclusive of transparent substrate)/(transmittance of transparent substrate)]×100.

Unless otherwise noted, here the value that of transmittance of the transparent two-layered film only without the transparent substrate, is used as the transmittance in the present specification.

Moreover, surface resistance of the transparent two-layered film was determined using the surface resistance meter (Loresta AP MCP-T400) of Mitsubishi Chemical Corporation. The haze value and visible light ray transmittance were determined using a haze meter (HR-200) made by Murakami Color Research Laboratory. Reflectance and the reflection and transmission profiles were determined using a spectrophotometer (U-4000) made by Hitachi Ltd. In addition, particle diameter of the noble metal-coated silver microparticles was evaluated under a transmission electron microscope made by JEOL Ltd.

Example 2

Ethanol (EA), propylene glycol monomethyl ether (PGM), diacetone alcohol (DAA) and formamide (FA) were added to the concentrated dispersion of noble metal-coated silver particles of Example 1 to obtain a transparent conductive layer forming coating liquid of Example 2 which includes noble metal-coated silver microparticles and formamide (Ag: 0.08%, Au: 0.32%, water: 10.7%, EA: 53.9%, PGM: 25%, DAA: 10%, FA: 0.01%).

In addition, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component was silicon oxide, that is, the transparent conductive layered structure of Example 2.

The film properties and the film defects of the transparent two-layered film that was formed on the glass substrate are shown in the following Table 1.

Example 3

Ethanol (EA), propylene glycol monomethyl ether (PGM), diacetone alcohol (DAA) and formamide (FA) were added to the concentrated dispersion of noble metal-coated silver particles of Example 1 to obtain a transparent conductive layer forming coating liquid of Example 3 which includes noble metal-coated silver microparticles and formamide (Ag: 0.08%, Au: 0.32%, water: 10.7%, EA: 53.4%, PGM; 25%, DAA: 10%, FA: 0.5%).

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Example 3.

The above-mentioned film properties and film defects of the transparent two-layered film formed on the glass substrate are shown in Table 1 below.

Example 4

Acetone, ethanol (EA), propylene glycol monomethyl ether (PGM), diacetone alcohol (DAA) and formamide (FA) were added to the concentrated dispersion of noble metal-coated silver particles of Example 1 to obtain a transparent conductive layer forming coating liquid of Example 4 which includes noble metal-coated silver microparticles and formamide (Ag: 0.072%, Au: 0.288%, water: 9.4%, acetone: 20%, EA: 35.1%, PGM: 25%, DAA: 10%, PA: 0.1%).

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Example 4.

The above-mentioned film properties and film defects of the transparent two-layered film formed on the glass substrate are shown in Table 1 below.

Example 5

Acetone, ethanol (EA), propylene glycol monomethyl ether (PGM), dimethylformamide (DMF) and formamide (FA) were added to the concentrated dispersion of noble metal-coated silver particles of Example 1 to obtain a transparent conductive layer forming coating liquid of Example 5 which includes noble metal-coated silver microparticles and formamide (Ag: 0.08%, Au: 0.32%, water: 10.7%, Acetone: 20%, EA: 28.6%, PGM; 10%, DMF: 30% FA: 0.3%).

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Example 5.

The above-mentioned film properties and film defects of the transparent two-layered film formed on the glass substrate are shown in Table 1 below.

Example 6

Ethanol (EA), 1-butanol (NBA), diacetone alcohol (DAA) and formamide (FA) were added to the concentrated dispersion of noble metal-coated silver particles of Example 1 to obtain a transparent conductive layer forming coating liquid of Example 6 which includes noble metal-coated silver microparticles and formamide (Ag: 0.08%, Au: 0.32%, water: 25.0%, EA: 56.5%, NBA: 8.0%. DAA: 10.0%, FA: 0.1%).

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Example 6.

The above-mentioned film properties and film defects of the transparent two-layered film formed on the glass substrate are shown in Table 1 below.

Example 7

With 89.5 g of diacetone alcohol, 10 g of composite oxide microparticles of iron, manganese and copper (TMB #3550, Dainichiseika Color & Chemicals Mfg. Co., Ltd.) and 0.5 g of dispersant were mixed, and dispersion treatment using a paint shaker with zirconia beads was performed, and then the liquid was desalted by an ion-exchange resin to obtain a dispersion of composite oxide microparticles of iron, manganese and copper with a dispersion particle diameter of 98 nm.

Next, the above-mentioned dispersion of composite oxide microparticles of iron, manganese and copper (this composite oxide microparticles of iron, manganese and copper will be abbreviated as Cu—Fe—Mn—O as needed hereinbelow), ethanol (EA), propylene glycol monomethyl ether (PGM), diacetone alcohol (DAA) and formamide (FA) were added to the concentrated dispersion of noble metal-coated silver particles of Example 1 to obtain a transparent conductive layer forming coating liquid of Example 7 which includes noble metal-coated silver microparticles and formamide (Ag: 0.08%, Au: 0.32%, Cu—Fe—Mn—O: 0.15%, water: 10.7%, EA: 53.65%, PGM: 25%, DAA: 10%, FA: 0.1%), Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and composite oxide microparticles of iron, manganese, and copper, and a transparent coat layer consisting of silicate film whose main component is silicon oxide, that is, the transparent conductive layered structure of Example 7.

The above-mentioned film properties and film defects of the transparent two-layered film formed on the glass substrate are shown in Table 1 below.

Example 8

Titanium chloride was hydrolyzed with aqueous alkali solution to obtain titanium hydroxide, which was heated at 800° C. in an ammonia gas to obtain black titanium oxynitride microparticles (nitrogen: 15.5%) with a mean particle diameter of 30 nm.

With 94.5 g of ethanol, 5 g of this black titanium oxynitride microparticles and 0.5 g of dispersant were mixed, and dispersion treatment using a paint shaker with zirconia beads was performed, and then the liquid was desalted by an ion-exchange resin to obtain a dispersion (black titanium oxynitride: 5%) of black titanium oxynitride (which will be abbreviated as $TiO_xN_y$ as needed hereinbelow) microparticles with a dispersion particle diameter of 93 nm.

Next, the dispersion of black titanium oxynitride microparticles, ethanol (EA), propylene glycol monomethyl ether (PGM), diacetone alcohol (DAA) and formamide (FA) were added to the concentrated dispersion of noble metal-coated silver particles of Example 1 to obtain a transparent conductive layer forming coating liquid of Example 8 which includes noble metal-coated silver microparticles, black titanium oxynitride microparticles and formamide (Ag: 0.08%, Au: 0.32%, $TiO_xN_y$: 0.20%, water: 10.7%, EA: 53.6%, PGM: 25%, DAA: 10%, FA: 0.1%), Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and black titanium oxynitride microparticles, and a transparent coat layer consisting of silicate film whose main component is silicon oxide, that is, the transparent conductive layered structure of Example 8.

The above-mentioned film properties and film defects of the transparent two-layered film formed on the glass substrate are shown in Table 1 below.

Example 9

With 25 g of water and 10.8 g of ethanol, 4 g of titanium nitride (TiN) microparticles (Netsuren Co., Ltd.) and 0.2 g of dispersant were mixed, and dispersion treatment using a paint shaker with zirconia beads was performed, and then the liquid was desalted by the above-mentioned ion-exchange resin to obtain a dispersion of titanium nitride microparticles with a dispersion particle diameter of 80 nm.

Next, the dispersion of titanium nitride microparticles, Ethanol (EA), propylene glycol monomethyl ether (PGM), diacetone alcohol (DAA) and formamide (FA) were added to the concentrated dispersion of noble metal-coated silver particles of Example 1 to obtain a transparent conductive layer forming coating liquid of Example 9 which includes noble metal-coated silver microparticles, titanium nitride microparticles and formamide (Ag: 0.08%, Au: 0.32%, TiN : 0.15%, water: 10.7%, EA: 53.65%, PGM: 25%, DAA: 10%, FA: 0.1%).

As a result of observing the above-mentioned transparent conductive layer forming coating liquid under a transmission electron microscope, the mean particle diameter of the titanium nitride microparticles was 20 nm.

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and titanium nitride microparticles, and a transparent coat layer consisting of silicate film whose main component is silicon oxide, that is, the transparent conductive layered structure of Example 9.

The above-mentioned film properties and film defects of the transparent two-layered film formed on the glass substrate are shown in Table 1 below.

Example 10

In the manufacturing process of the colloidal dispersion of the noble metal-coated silver microparticles of the Example 1, ethanol (EA), propylene glycol monomethyl ether (PGM), diacetone alcohol (DAA) and formamide (FA) were added to the concentrated dispersion which was obtained in a changed blending condition of raw materials to obtain a transparent conductive layer forming coating liquid of Example 10 which includes noble metal-coated silver microparticles and formamide (Ag: 0.13.%, Au: 0.26%, water: 10.7%, EA: 53.8%, PGM: 25%, DAA: 10%, FA: 0.1%).

As a result of observing the above-mentioned transparent conductive layer forming coating liquid under a transmission electron microscope, the mean particle diameter of the noble metal-coated silver microparticles was 7.1 nm.

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Example 10.

The above-mentioned film properties and film defects of the transparent two-layered film formed on the glass substrate are shown in Table 1 below.

Example 11

In the manufacturing process of the colloidal dispersion of the noble metal-coated silver microparticles of the Example 1, ethanol (EA), propylene glycol monomethyl ether (PGM), diacetone alcohol (DAA) and formamide (FA) were added to the concentrated dispersion which was obtained in a changed blending condition of raw materials to obtain a transparent conductive layer forming coating liquid of Example 11 which includes noble metal-coated silver microparticles and formamide (Ag: 0.05%, Au: 0.45%, water: 10.7%, EA: 53.7%, PGM: 25%, DAA: 10%, FA: 0.1%).

As a result of observing the above-mentioned transparent conductive layer forming coating liquid under a transmission electron microscope, the mean particle diameter of the noble metal-coated silver microparticles was 8.3 nm.

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Example 11.

The above-mentioned film properties and film defects of the transparent two-layered film formed on the glass substrate are shown in Table 1 below.

Comparative Example 1

Ethanol (EA), propylene glycol monomethyl ether (PGM) and diacetone alcohol (DAA) were added to the concentrated dispersion of noble metal-coated silver particles of Example 1 to obtain a transparent conductive layer forming coating liquid of Comparative Example 1 which includes noble metal-coated silver microparticles, but does not include formamide (Ag: 0.08%, Au: 0.32%, water: 10.7%, EA: 53.9%. PGM: 25%, DAA: 10%).

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Comparative Example 1.

The above-mentioned film properties and film defects of the transparent two-layered film formed on the glass substrate are shown in Table 1 below.

Comparative Example 2

Acetone, ethanol (EA), propylene glycol monomethyl ether (PGM) and dimethylformamide (DMF) were added to the concentrated dispersion of noble metal-coated silver particles of Example 1 to obtain a transparent conductive layer forming coating liquid of Comparative Example 2 which includes noble metal-coated silver microparticles, but does not include formamide (Ag: 0.08%, Au: 0.32%, water: 10.7%, acetone: 20%, EA: 48.9%. PGM: 10%, DMF: 30%).

Moreover, other than the fact that this transparent conductive layer forming coating liquid was used, the same treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Comparative Example 2.

The above-mentioned film properties and film defects of the transparent two-layered film formed on the glass substrate are shown in Table 1 below.

Comparative Example 3

Ethanol (EA), propylene glycol monomethyl ether (PGM), diacetonalcohol (DAA) and formamide (FA) were added to the concentrated dispersion of noble metal-coated silver particles of Example 1 to obtain a transparent conductive layer forming coating liquid of Comparative Example 3 which includes noble metal-coated silver microparticles and formamide (Ag: 0.08%, Au: 0.32%, water: 10.7%, EA: 52.4%, PGM: 25%, DAA: 10%, FA: 1.5%).

Moreover, this transparent conductive layer forming coating liquid was spin-coated as in the similar condition of Example 1 (150 rpm, 60 seconds), but the coating liquid was not sufficiently dried. Therefore, additional drying of 120 seconds was performed but in vain.

Next, a silica sol liquid was spin coated (150 rpm, 60 seconds) succeedingly, on the transparent conductive layer which was not enough dried out, however, the above-mentioned glass substrate with a transparent two-layered film was not obtained because a part of the transparent conductive layer was washed away by the silica sol liquid.

Comparative Example 4

Ethanol (EA) were added to the concentrated dispersion of noble metal-coated silver particles of Example 1 to obtain a transparent conductive layer forming coating liquid of Comparative Example 4 which includes noble metal-coated silver microparticles, but does not include formamide (Ag: 0.08%, Au: 0.32%, water: 10.7%, EA: 88.9%).

Moreover, other than the fact that this transparent conductive layer forming coating liquid was used, the treatment as in Example 1 was performed to obtain a glass substrate with a transparent two-layered film composed of a transparent conductive layer comprising noble metal-coated silver microparticles and a transparent coat layer consisting of silicate film whose main component is silicon oxide, that is, the transparent conductive layered structure of Comparative Example 4.

The above-mentioned film properties and film defects of the transparent two-layered film formed on the glass substrate are shown in Table 1 below.

TABLE 1

| | Type of micro-particles | Coating amount of metal (Note 1) | Type of color pigment micro-particles | Solvent composition of transparent conductive layer forming coating liquid: FA content (%) | Solvent composition of transparent conductive layer forming coating liquid: Solvent system | Surface resistance (Ω/□) | Visible light ray transmittance (%) | Standard deviation of transmittance (Note 2) | Haze value (%) | Bottom reflectance (%)/bottom wavelength (nm) | Film defect (Note 3) |
|---|---|---|---|---|---|---|---|---|---|---|---|
| Example 1 | Ag-Au | 400 wt parts | None | 0.1 | EA-water-PGM-DAA-FA | 252 | 83.3 | 1.49 | 0.1 | 0.25/565 | Good |
| Example 2 | Ag-Au | 400 wt parts | None | 0.01 | EA-water-PGM-DAA-FA | 348 | 80.6 | 1.75 | 0.1 | 0.31/560 | Good |
| Example 3 | Ag-Au | 400 wt parts | None | 0.5 | EA-water-PGM-DAA-FA | 253 | 81.1 | 1.50 | 0.1 | 0.25/530 | Good |
| Example 4 | Ag-Au | 400 wt parts | None | 0.1 | Acetone-EA-water-PGM-DAA-FA | 275 | 81.8 | 1.52 | 0.1 | 0.07/575 | Good |
| Example 5 | Ag-Au | 400 wt parts | None | 0.3 | Acetone-EA-water-PGM-DAA-FA | 375 | 85.1 | 1.40 | 0.1 | 0.46/535 | Good |
| Example 6 | Ag-Au | 400 wt parts | None | 0.1 | EA-water-NBA-DAA-FA | 283 | 80.4 | 1.43 | 0 | 0.19/555 | Good |
| Example 7 | Ag-Au | 400 wt parts | Fe—Cu—Mn—O | 0.1 | EA-water-PGM-DAA-FA | 914 | 70.8 | 2.53 | 0.5 | 0.04/605 | Good |
| Example 8 | Ag-Au | 400 wt parts | $TiO_2N_2$ | 0.1 | EA-water-PGM-DAA-FA | 733 | 66.3 | 3.91 | 0.4 | 0.01/625 | Good |
| Example 9 | Ag-Au | 400 wt parts | TiN | 0.1 | EA-water-PGM-DAA-FA | 457 | 66.1 | 2.50 | 0.8 | 0.09/540 | Good |
| Example 10 | Ag-Au | 200 wt parts | None | 0.1 | EA-water-PGM-DAA-FA | 244 | 83.5 | 1.48 | 0.1 | 0.26/535 | Good |
| Example 11 | Ag-Au | 900 wt parts | None | 0.1 | EA-water-PGM-DAA-FA | 177 | 83.4 | 1.59 | 0.1 | 0.08/525 | Good |
| Comparative Example 1 | Ag-Au | 400 wt parts | None | 0 | EA-water-PGM-DAA | 1720 | 79.0 | 2.42 | 0.1 | 0.28/605 | No good |
| Comparative Example 2 | Ag-Au | 400 wt parts | None | 0 | Acetone-EA-water-PGM-DMF | 2230 | 83.1 | 2.36 | 0.1 | 0.23/620 | No good |
| Comparative Example 3 | Ag-Au | 400 wt parts | None | 1.5 | EA-water-PGM-DAA-FA | — | — | — | — | — | — |

TABLE 1-continued

| | Type of micro-particles | Coating amount of metal (Note 1) | Type of color pigment micro-particles | Solvent composition of transparent conductive layer forming coating liquid: FA content (%) | Solvent system | Surface resistance (Ω/□) | Visible light ray transmittance (%) | Standard deviation of transmittance (Note 2) | Haze value (%) | Bottom reflectance (%)/ bottom wavelength (nm) | Film defect (Note 3) |
|---|---|---|---|---|---|---|---|---|---|---|---|
| Comparative Example 4 | Ag-Au | 400 wt parts | None | 0 | EA-water | 185 | 80.2 | 1.46 | 0.1 | 0.14/540 | No good |

Note 1: Coating amount of noble metals to 100 parts by weight of silver.
Note 2: Value in terms of the transmittance (%) of the transparent two-layered film only without the transparent substrate at each wavelength in 5 nm intervals in the visible light ray wavelength region (380 to 780 nm).
Note 3: Fine aggregates (black) occurred all over the surface of the film in Comparative Examples 1 and 2. In the Comparative Example 4, traces of wiping of the glass substrate was seen as itself in the transparent conductive layer and moreover, radial striations were found easily by visual inspection.

[Chemical Resistance Tests]

The transparent conductive layered structures of Examples 1 through 11 and the transparent conductive layered structures of Comparative Examples 1, 2 and 4 were immersed in 5% brine for 24 hours and surface resistance and film appearance of the transparent two-layered film on the transparent substrate (glass substrate) were investigated. However, no change was observed.

[Film Strength Tests]

Pencil hardness tests (wherein lines are drawn on a film surface with pencils having a hardness of H though 9H under a load of 1 kg, and abrasions are observed and evaluated) were performed on the transparent conductive layered structures of Examples 1 through 11 and the transparent conductive layered structures of Comparative Examples 1, 2 and 4, to investigate film strength of the transparent two-layered film on the transparent substrate (glass substrate). The results are shown in Table 2 below.

TABLE 2

| | Pencil Hardness |
|---|---|
| Example 1 | 6H |
| Example 2 | 6H |
| Example 3 | 6H |
| Example 4 | 6H |
| Example 5 | 6H |
| Example 6 | 6H |
| Example 7 | 6H |
| Example 8 | 6H |
| Example 9 | 6H |
| Example 10 | 6H |
| Example 11 | 6H |
| Comparative Example 1 | 3H |
| Comparative Example 2 | 3H |
| Comparative Example 4 | 6H |

[Evaluation]

1. The following are confirmed from the results in Table. First, in the transparent two-layered film of Comparative Example 1, 2 and 4, film defects (fine aggregates occurring all over the surface of the film, defects such as a trace of wiping on the glass substrate which is seen as itself in the transparent conductive layer and radial striations which are easily observed by visual inspection) were found, while the above-mentioned defects were not found in the transparent two-layered film of each Example. In addition, the surface resistance of the transparent two-layered film of Comparative Examples 1 and 2 is 1720 (Ω/□) and 2230 (Ω/□), respectively, while that of transparent two-layered film of each Example is 177 (Ω/□) to 914 (Ω/□). Therefore, it is confirmed that the conductivity is improved.

When compared to the Comparative Example 3, in which the drying of the transparent conductive layer forming coating liquid was too slow to obtain a transparent two-layered film, a high quality transparent conductive layer with low surface resistance and no film defects can be obtained in the transparent two-layered film of each Example.

2. When meshy structures of transparent two-layered film of each Example and Comparative Examples 1, 2 and 4 were observed under a transmission electron microscope (TEM), developed meshy structures formed by noble metal microparticle chains of conjunct microparticles were observed in each Example. However, in Comparative Example 4, it was found meshy structures formed by collective microparticles which are connected in zone, not in chain, and in Comparative Examples 1 and 2, it was confirmed that meshy structures were not sufficiently formed.

3. According to the results shown in Table 2, it was confirmed that when compared with the transparent two-layered films of Comparative Examples 1 and 2 in which forming of meshy structures were not sufficient, the transparent two-layered film of each Example has a high pencil strength of 6H, and that the good strength of film is obtained by the developed meshy structures of noble metal microparticles.

According to the transparent conductive layer forming coating liquid of the present invention described in claims 1 through 8, since the transparent conductive layer forming coating liquid for forming a transparent conductive layer on a transparent substrate, comprises, as its main components, a solvent and noble metal microparticles with a mean particle diameter of 1 to 100 nm dispersed in the solvent, wherein the solvent comprises 0.005 to 1.0 wt % of formamide ($HCONH_2$), it is possible to form a conductive film having a more developed meshy structure easily on the transparent substrate, and as a result thereof, it has an effect capable of forming a transparent conductive layer having such characteristics as high transmittance, low resistance, low reflectance and high strength and with few film defects.

What is claimed is:

1. A transparent conductive layer forming coating liquid for forming a transparent conductive layer on a transparent substrate, comprising, as its main components, a solvent and noble metal microparticles with a mean particle diameter of 1 to 100 nm dispersed in the solvent, wherein the solvent comprises 0.005 to 1.0 wt % of formamide ($HCONH_2$).

2. A transparent conductive layer forming coating liquid according to claim 1, wherein the solvent further comprises an organic solvent being compatible with water and having a boiling point of 100 to 190° C., 1 to 50 wt % of water, and a component selected from a group consisting of a monohydric alcohol containing 5 carbon atoms or less, a ketone containing 6 carbon atoms or less or mixtures thereof.

3. A transparent conductive layer forming coating liquid according to claim 1, wherein the noble metal microparticles are selected from a group consisting of gold, silver, platinum, palladium, rhodium, ruthenium, alloy microparticles of gold, alloy microparticles of silver, alloy microparticles of platinum, alloy microparticles of palladium, alloy microparticles of rhodium, alloy microparticles of ruthenium, gold-coated silver microparticles, platinum-coated silver microparticles, palladium-coated silver microparticles, rhodium-coated silver microparticles or ruthenium-coated silver microparticles.

4. A transparent conductive layer forming coating liquid according to claim 3, wherein the noble metal-coated silver microparticles are silver microparticles coated with gold or platinum only or a composite of gold and platinum.

5. A transparent conductive layer forming coating liquid according to claim 4, wherein the coated amount of gold or platinum only or a composite of gold and platinum in the noble metal-coated silver microparticles is set in the range from 5 to 1900 parts by weight to 100 parts by weight of silver.

6. A transparent conductive layer forming coating liquid according to claim 1, including color pigment microparticles.

7. A transparent conductive layer forming coating liquid according to claim 6, wherein the color pigment microparticles are selected from a group consisting of carbon, titanium black, titanium nitride, composite oxide pigment, cobalt violet, molybdenum orange, ultramarine, Prussian blue, quinacridone pigment, anthraquinone pigment, perylene pigment, isoindolinone pigment, azo pigment, phthalocyanine pigment and mixtures thereof.

8. A transparent conductive layer forming coating liquid according to claim 1, including an inorganic binder.

9. A transparent conductive layer forming coating liquid according to claim 2, wherein the noble metal microparticles are selected from a group consisting of gold, silver, platinum, palladium, rhodium, ruthenium, alloy microparticles of gold, alloy microparticles of silver, alloy microparticles of platinum, alloy microparticles of palladium, alloy microparticles of rhodium, alloy microparticles of ruthenium, gold-coated silver microparticles, platinum-coated silver microparticles, palladium-coated silver microparticles, rhodium-coated silver microparticles or ruthenium-coated silver microparticles.

10. A transparent conductive layer forming coating liquid according to claim 9, wherein the noble metal-coated silver microparticles are silver microparticles coated with gold or platinum only or a composite of gold and platinum.

11. A transparent conductive layer forming coating liquid according to claim 10, wherein the coated amount of gold or platinum only or a composite of gold and platinum in the noble metal-coated silver microparticles is set in the range from 5 to 1900 parts by weight to 100 parts by weight of silver.

12. A transparent conductive layer forming coating liquid according to any of claims 2 through 5 and claims 9 through 11, including color pigment microparticles.

13. A transparent conductive layer forming coating liquid according to claim 12, including an inorganic binder.

14. A transparent conductive layer forming coating liquid according to any of claims 2 through 7 and claims 9 through 11, including an inorganic binder.

* * * * *

UNITED STATES PATENT AND TRADEMARK OFFICE

CERTIFICATE OF CORRECTION

PATENT NO. : 6,569,359 B2
DATED : May 27, 2003
INVENTOR(S) : Masaya Yukinobu et al.

It is certified that error appears in the above-identified patent and that said Letters Patent is hereby corrected as shown below:

Title page, Item [54] and Column 1, lines 1-3,
Please replace "TRANSPARENT CONDUCTIVE LAYER FORMING COATING LIQUID CONTAINING FORMAMIDE"; with
-- TRANSPARENT CONDUCTIVE LAYER FORMING COATING LIQUID --.

Signed and Sealed this

Sixth Day of January, 2004

JAMES E. ROGAN
*Director of the United States Patent and Trademark Office*